US006679629B1

(12) United States Patent
Benito-Navazo

(10) Patent No.: US 6,679,629 B1
(45) Date of Patent: Jan. 20, 2004

(54) DEVICE FOR MANUALLY OPENING FLEXIBLE PACKAGES

(75) Inventor: Juan Manuel Benito-Navazo, Sant Cugat del Vallés (ES)

(73) Assignee: Aparellaje Electrico, S.A., Barcelona (ES)

( * ) Notice: Subject to any disclaimer, the term of this patent is extended or adjusted under 35 U.S.C. 154(b) by 25 days.

(21) Appl. No.: 09/714,232

(22) Filed: Nov. 17, 2000

(30) Foreign Application Priority Data

Nov. 23, 1999 (ES) ..... 9902951

(51) Int. Cl.[7] ..... B65D 33/14

(52) U.S. Cl. ..... 383/9; 383/200; 383/209; 206/466

(58) Field of Search ..... 383/9, 10, 200, 383/207, 208, 209, 906, 202; 206/466

(56) References Cited

U.S. PATENT DOCUMENTS

| | | | | | |
|---|---|---|---|---|---|
| 2,499,528 | A | * | 3/1950 | Reitzes | 383/208 |
| 2,536,529 | A | * | 1/1951 | Bergstein | 383/209 X |
| 2,541,674 | A | * | 2/1951 | Snyder | 383/209 |
| 2,851,212 | A | * | 9/1958 | Parmer | 383/200 |
| 3,083,876 | A | * | 4/1963 | Schneider et al. | 383/208 X |
| 3,171,581 | A | * | 3/1965 | Kugler | 206/484 |
| 3,397,835 | A | * | 8/1968 | Henning | 383/200 X |
| 3,520,471 | A | * | 7/1970 | Faust | 383/200 X |
| 3,663,239 | A | * | 5/1972 | Rowe et al. | 383/200 X |
| 3,759,439 | A | | 9/1973 | Cross et al. | |
| 3,809,220 | A | * | 5/1974 | Arcudi | 206/484 |
| 4,696,404 | A | * | 9/1987 | Corella | 383/200 |
| 5,169,696 | A | * | 12/1992 | Lang et al. | 383/200 X |
| 5,175,011 | A | * | 12/1992 | Courvoisier et al. | 383/200 X |
| 5,219,229 | A | * | 6/1993 | Sengewald | 383/207 |
| 5,593,229 | A | * | 1/1997 | Warr | 383/209 |
| 5,735,401 | A | * | 4/1998 | Cassou et al. | 383/207 X |
| 5,826,985 | A | * | 10/1998 | Goodman et al. | 383/200 |
| 5,914,142 | A | * | 6/1999 | Zartner | 383/209 X |

FOREIGN PATENT DOCUMENTS

| | | | | |
|---|---|---|---|---|
| EP | WO 99/35048 | | 7/1999 | |
| FR | 1399493 | | 9/1965 | |
| GB | 2168680 A | | 6/1986 | |
| JP | 0137356 | * | 2/1989 | 383/200 |
| JP | 405254551 A | * | 10/1993 | 383/200 |
| JP | 406122471 A | * | 5/1994 | 383/200 |
| NL | 7015601 | * | 4/1972 | 383/209 |

* cited by examiner

*Primary Examiner*—Jes F. Pascua

(57) ABSTRACT

A device for manually opening a flexible package, in the form of a bag (1) made from plastics film which is closed by a weld line of closure (4) which is arranged at a filling mouth (2) in such a way as to leave a free skirt. The bag (1) has, at one side end of the filling mouth (2), a weakening line (3) of defined length which is located between the weld line of closure (4) of the filling mouth (2) and a free edge (5) of the filling mouth (2), with the weakening line (3) being directed in such a way as to be located in a contemplated trajectory of manual tearing of the bag (1). The trajectory intersects the weld line of closure (4) and extends across a corner (6) of the bag (1) immediately adjacent the weakening line (3), defining a delivery orifice (10). It is applied preferably to bags of the type for containing a plurality of articles which have to be maintained in a controlled environment and/or must be removed one by one through a small sized delivery orifice (10).

5 Claims, 2 Drawing Sheets

DEVICE FOR MANUALLY OPENING FLEXIBLE PACKAGES

FIELD OF THE INVENTION

This invention relates to a device for manually opening flexible packages, to be precise, flexible packages formed by bags made from plastics film which are closed by a weld line which is arranged at the filling mouth thereof in such a way as to leave a free skirt of the bag for the formation of holding and/or suspension means therefor, and more particularly the bags of this type which are for containing a plurality of articles which must be kept a controlled-moisture environment and/or be removed one by one, in one or more operations, through a delivery orifice of small section, which must be small so as to maintain the internal environment as long as possible and avoid the uncontrolled spilling of the bag content.

PRIOR ART

The majority of flexible packages of the plastics film bag type, where the mouth is closed by a weld line, lack specific manual opening means and must be opened either with the use of scissors, knives or other means, by which it is possible attain control of the position and section of the aperture, or by tearing with brute force, whereby neither the position nor the size of the aperture can be controlled.

Where the packaged article is one in number, the means used for opening the package are of no import, since it must be disposed of. On the other hand, where the articles enclosed are plural in number, and they are to be used one by one or in small numbers in each removal operation, some integrity of the package must be maintained so as adequately to contain the remaining articles for keeping them for future use. In this case, it is of interest to form an aperture in the pack, serving as a delivery orifice for removal of the articles, which is of the smallest possible size, depending on the dimensions of the articles. In such cases, it is absolutely necessary to use scissors, knives or other cutting instruments, so as to form the aperture at a particular point and with the resulting size of the delivery orifice being adjusted to the dimensions of the articles.

Under these circumstances, the problem may arise that the user does not have to hand the appropriate tools for forming the aperture in the desired way, or the operation is troublesome, such as is the case where the user is up a stepladder or in another situation where handling of the package is difficult.

Thus, for all cases, it would be desirable to have an arrangement allowing the controlled opening of flexible packages, by direct manual operation, without the need for any tool whatsoever.

SUMMARY OF THE INVENTION

With a view to satisfying such need, the device for opening flexible packages according to the invention has been developed. This consists of the arrangement, at one side end of the filling mouth of the bag, of a weakening line of defined length and of stiffened edges which, being located between the weld line of closure of the bag mouth and the free edge of this mouth, is directed in such a way as to be located in a contemplated trajectory of manual tearing of the bag, which intersects the said weld line of closure and extends across the corner of the bag immediately adjacent the weakening line.

One feature of the invention is to be found in the fact that the weakening line arranged in the bag filling mouth is formed by a line of cut which passes through the walls of said mouth and is stiffened by a perimetral weld line, forming a buttonhole-like arrangement. Alternatively, the weakening line contemplated in the bag filling mouth may be formed by a perforated line, the perforations of which extend through the walls of the mouth and which may in turn by stiffened by a perimetral weld line.

A further feature of the invention resides in the fact that the weakening line is located between two parallel weld lines, one of which is the weld line of closure of the bag and the other is disposed in the skirt of the mouth, comprising between both holding and/or hanging means for the bag.

Yet a further feature of the invention is to be found in the fact that the extension of the weakening line intersects the weld line of closure at an angle of about 60°.

The invention envisages that the ends of the weakening line are respectively equidistant from both weld lines and the distance between the end closest to the weld line of closure and the side edge of the bag is determined by the dimension that the delivery orifice is required to have to allow for removal of the packaged articles one by one.

It is also envisaged that the section of the delivery orifice resulting from a tearing operation is of such a small size that, when open, it allows the controlled environment inside the bag to be essentially maintained and controlled delivery of the packaged articles.

BRIEF DESCRIPTION OF THE DRAWING

To facilitate the understanding of the foregoing ideas, there is described hereafter one preferred embodiment of the invention, with reference to the accompanying drawings, in which.

DETAILED DESCRIPTION OF THE INVENTION

Figure 1:
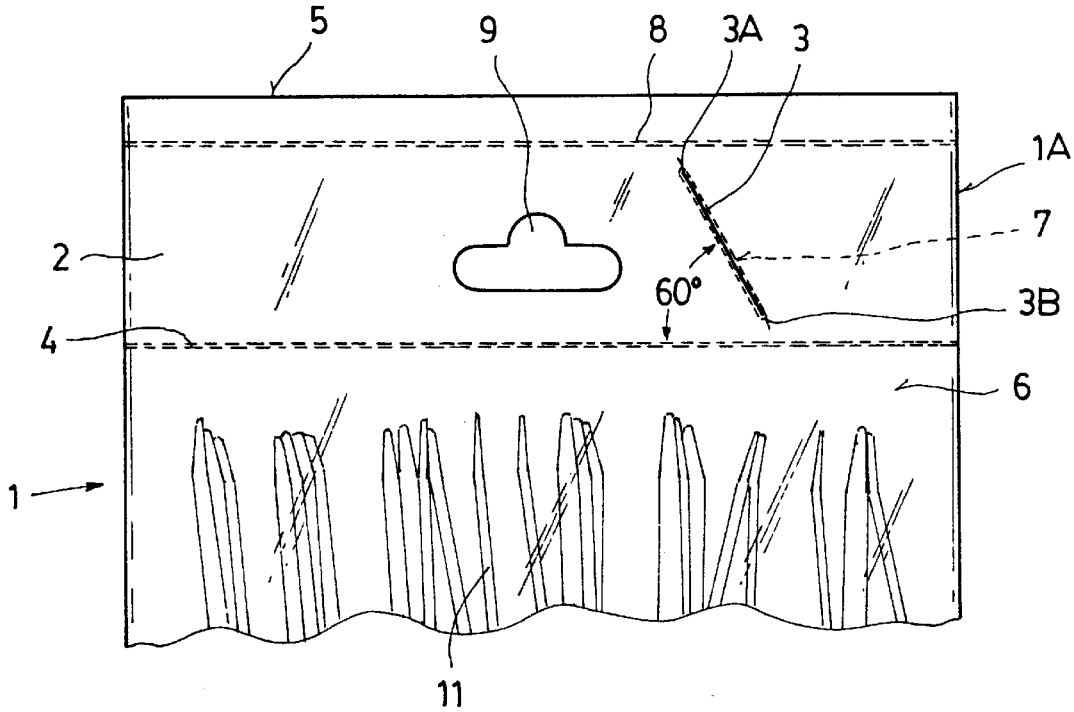
FIG. 1 shows the filling mouth of a flexible package of the plastics bag type, in which two weld lines, suspension means and the opening device of the invention are to be observed.
Figure 2:
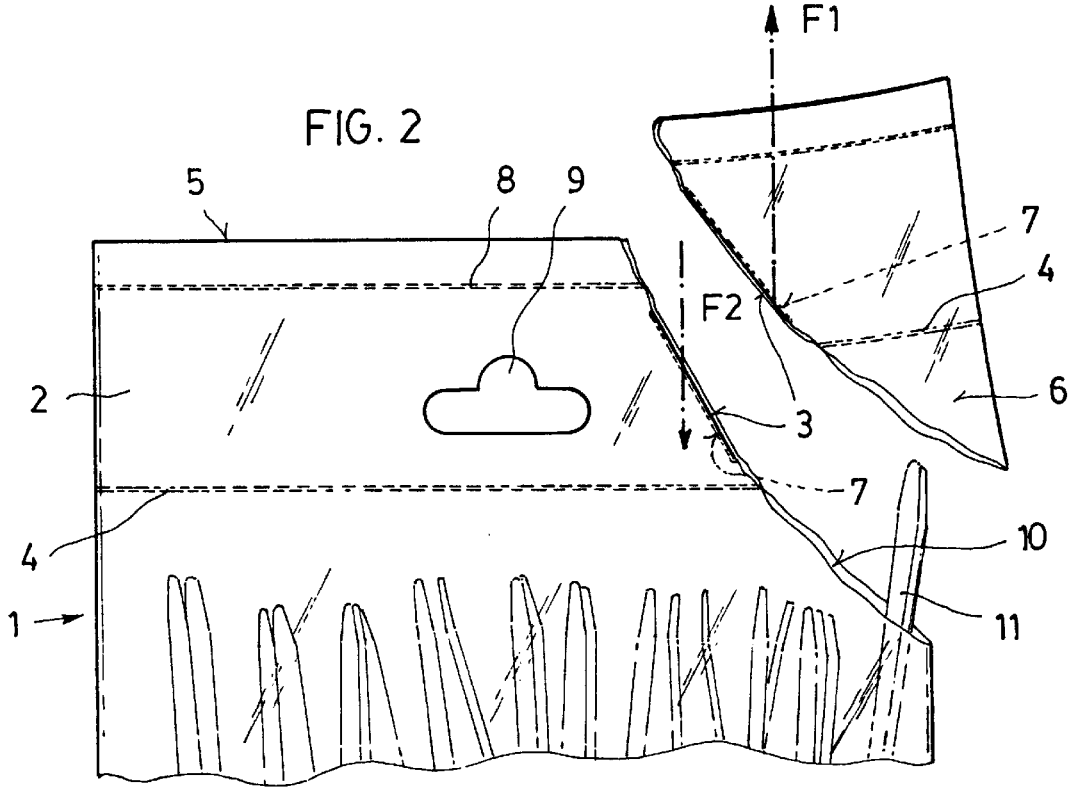
FIG. 2 shows the mouth of the previous figure, once the flexible package has been opened by means of the device of the invention.

The device for manually opening of flexible packages, such as bags 1, consists of the arrangement, at one side end of the filling mouth 2 of the bag 1, of a weakening line 3 of defined length and stiffened edges, which, situated between the weld line of closure 4 of the mouth 2 of the bag 1 and the free edge 5 of said mouth 2, is directed in such a way as to be located in a contemplated trajectory of manual tearing of the bag 1 which intersects the said weld line of closure 4 and extends across the corner 6 of the bag 1 immediately adjacent the weakening line 3.

Figure 3:
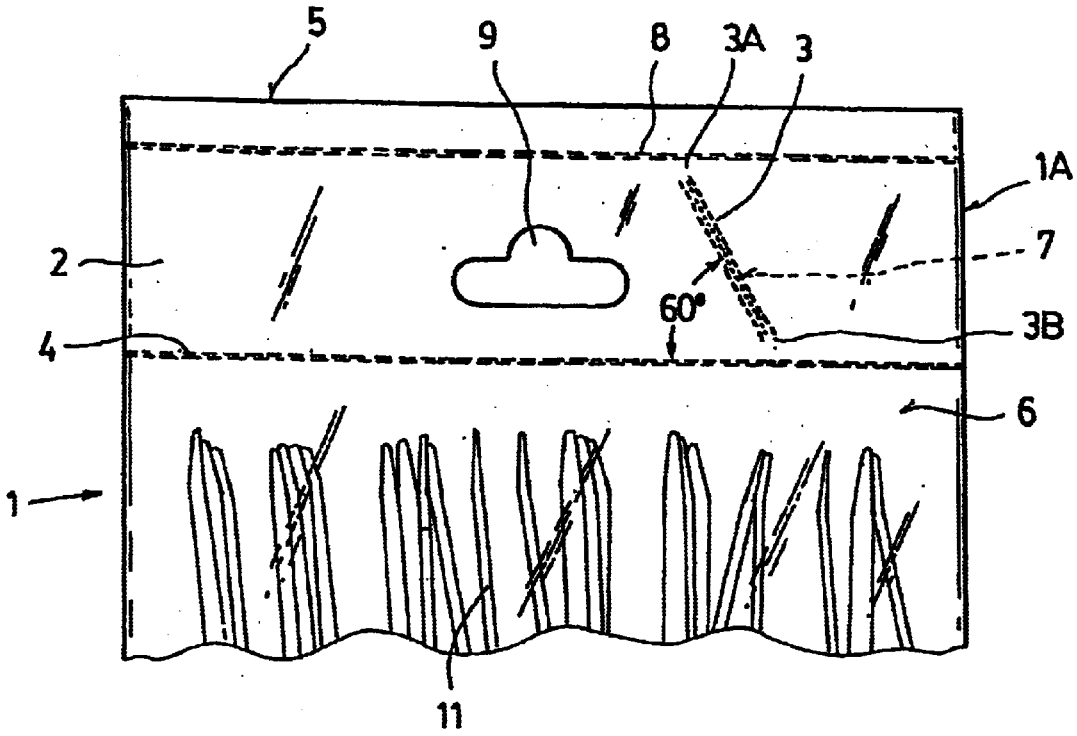
FIG. 3 shows the filling mouth having a perforated weakening line.

The weakening line 3 may be formed by a line of cut (FIG. 1) which passes through the walls of said mouth 2 in buttonhole-like fashion, or by a line of perforations (FIG. 3), being provided in both cases with a perimetral stiffening 7 which may be formed by a continuous or discontinuous line of weld.

Preferably the weakening line 3 will be located between two parallel weld lines, one of which forms the weld line of closure 4 and the other of which consists of an auxiliary weld line 8 arranged on the skirt of the mouth 2, there being comprised between both weld lines also suspension and/or holding means 9.

Practice has shown that the most efficient embodiment of the invention comprises the fact that the extension of the weakening line 3 intersects the weld line of closure 4 at an angle of 60°.

Also, the ends 3A and 3B of the weakening line 3 are equidistant, respectively, from the weld line of closure 4 and auxiliary line 8, and the distance between the end 3B, which is the one closest to the weld line of closure 4, and the side edge 1A of the bag 1, is determined by the size of the delivery orifice 10 required for one-by-one removal of the packaged articles 11 which, as shown as an example in the drawing, may consist of polyamide ties for binding electric cables.

The said delivery orifice 10 must be small so as to maintain essentially the conditions of the internal environment of the bag 1 and to avoid accidental spilling of the content thereof.

Manual opening is achieved by applying oppositely directed forces, as shown by the arrows F1 and F2, with the fingers of the hand in the edge areas bordering on the weakening line 3, which, with the aid of the perimetral stiffening 7, cause the bag 1 to tear in the direction of the weakening line 3, breaking through the weld line of closure 4 and cutting the corner 6 of the bag, all in a direction and size contemplated for the delivery orifice 10.

This device for opening flexible packages is obviously applicable to all types of flexible packages containing solid articles pertaining to the food, cosmetic, pharmaceutical industries, hardware stores, electrical and electronic components, etc.

What I claim is:

1. A device to manually open a bag made from a plastic film that is closed by a first weld line arranged at a filling mouth of said bag to allow a free skirt of said bag to be left to form a holding and/or suspension unit for the bag, the bag containing a plurality of articles which are removed one by one, in one or more operations, through a small sectioned emptying mouth, the device comprising:

a second weld line, parallel to the first weld line, the first and second weld lines defining an intermediate area; and a weakening line, at a side of the intermediate area, edges of the weakening line being stiffened by welding, the weakening line being located at an angle relative to the first and second weld lines, without contacting the first and second weld lines and extending according to a contemplated trajectory of manual tearing of the bag, the manual tearing of the bag being performed by acting on said weakening line, the trajectory of the manual tearing intersecting the first and second welding lines and separating a corner of the bag to define a delivery orifice, said weakening line comprises first and second ends which are equidistant from said first and second weld lines, respectively, the first end corresponding to the first weld line, and a distance between a first end of the weakening line and a side of said bag corresponding thereto is determined by a required dimension of said delivery orifice to allow for removal of the articles one by one.

2. A device to manually open a bag made from a plastic film that is closed by a first weld line arranged at a filling mouth of said bag to allow a free skirt of said bag to be left to form a holding and/or suspension unit for the bag, the bag containing a plurality of articles which are removed one by one, in one or more operations, through a small sectioned emptying mouth, the device comprising:

a second weld line, parallel to the first weld line, the first and second weld lines defining an intermediate area; and a weakening line, at a side of the intermediate area, edges of the weakening line being stiffened by welding, the weakening line being located at an angle relative to the first and second weld lines, extending only between the first and second weld lines according to a contemplated trajectory of manual tearing of the bag, the manual tearing of the bag being performed by acting on said weakening line, the trajectory of the manual tearing intersecting the first and second welding lines and separating a corner of the bag to define a delivery orifice, wherein:

said weakening line is located between the first and second weld lines, and the device further comprises holding and/or hanging means between the first and second weld lines.

3. A device to manually open a bag made from a plastic film that is closed by a first weld line arranged at a filling mouth of said bag to allow a free skirt of said bag to be left to form a holding and/or suspension unit for the bag, the bag containing a plurality of articles which are removed one by one, in one or more operations, through a small sectioned emptying mouth, the device comprising:

a second weld line, parallel to the first weld line, the first and second weld lines defining an intermediate area; and a weakening line, at a side of the intermediate area, edges of the weakening line being stiffened by welding, the weakening line being located at an angle relative to the first and second weld lines, without contacting the first and second weld lines and extending according to a contemplated trajectory of manual tearing of the bag, the manual tearing of the bag being performed by acting on said weakening line, the trajectory of the manual tearing intersecting the first and second welding lines and separating a corner of the bag to define a delivery orifice, wherein:

said weakening line is located between the first and second weld lines, the device further comprises holding and/or hanging means between the first and second weld lines, said weakening line comprises first and second ends which are equidistant from said first and second weld lines, respectively, and a distance between the first end of the weakening line and the side edge of said bag, corresponding thereto is determined by a required dimension of said delivery orifice to allow for the removal of the articles one by one.

4. A device to manually open a bag made from a plastic film that is closed by a first weld line arranged at a filling mouth of said bag to allow a free skirt of said bag to be left to form a holding and/or suspension unit for the bag, the bag containing a plurality of articles which are removed one by one, in one or more operations, through a small sectioned emptying mouth, the device comprising:

a second weld line, parallel to the first weld line, the first and second weld lines defining an intermediate area; and a weakening line, at a side of the intermediate area, edges of the weakening line being stiffened by welding, the weakening line being located at an angle relative to the first and second weld lines, without contacting the first and second weld lines and extending according to a contemplated trajectory of manual tearing of the bag, the manual tearing of the bag being performed by acting on said weakening line, the trajectory of the manual tearing intersecting the first and second welding lines and separating a corner of the bag to define a delivery orifice, wherein a size of the delivery orifice allows a controlled environment inside said bag to be maintained and allows for a controlled delivery of the articles.

5. A device to manually open a bag made from a plastic film that is closed by a first weld line arranged at a filling mouth of said bag to allow a free skirt of said bag to be left to form a holding and/or suspension unit for the bag, the bag containing a plurality of articles which are removed one by one, in one or more operations, through a small sectioned emptying mouth, the device comprising:

a second weld line, parallel to the first weld line, the first and second weld lines defining an intermediate area; and a weakening line, at a side of the intermediate area, edges of the weakening line being stiffened by welding, the weakening line being located at an angle relative to the first and second weld lines, without contacting the first and second weld lines and extending according to a contemplated trajectory of manual tearing of the bag, the manual tearing of the bag being performed by acting on said weakening line, the trajectory of the manual tearing intersecting the first and second welding lines and separating a corner of the bag to define a delivery orifice, wherein the bag maintains the articles in a controlled environment and is adapted to remove the articles one by one, in one or more operations.

* * * * *